United States Patent [19]

Premel

[11] Patent Number: 4,564,067

[45] Date of Patent: Jan. 14, 1986

[54] WASTE-HEAT TANK

[75] Inventor: Ulrich Premel, Gummersbach, Fed. Rep. of Germany

[73] Assignee: L. & C. Steinmüller GmbH, Gummersbach, Fed. Rep. of Germany

[21] Appl. No.: 468,895

[22] Filed: Feb. 23, 1983

[30] Foreign Application Priority Data

Feb. 24, 1982 [DE] Fed. Rep. of Germany ..... 3206511

[51] Int. Cl.[4] ..... F28D 7/10; F22B 1/18

[52] U.S. Cl. ..... 165/163; 165/160; 122/7 R

[58] Field of Search ..... 122/7 R, 6 A, 32, 34; 165/145, 160, 163

[56] References Cited

U.S. PATENT DOCUMENTS

| | | | |
|---|---|---|---|
| 1,752,673 | 4/1930 | Ladd | 122/7 R |
| 1,907,736 | 5/1933 | Cheetham et al. | 122/7 R |
| 3,356,159 | 12/1967 | Csathy et al. | 122/7 R |
| 3,712,371 | 1/1973 | Ter Haran | 122/7 R |
| 3,915,224 | 10/1975 | Richter | 165/163 |
| 4,029,054 | 6/1977 | Schuurman | 122/7 R |
| 4,151,217 | 4/1979 | Amano et al. | 122/7 R |

FOREIGN PATENT DOCUMENTS

| | | | |
|---|---|---|---|
| 6768 | 8/1956 | Fed. Rep. of Germany | 122/7 R |
| 2039022 | 4/1980 | United Kingdom | 165/145 |

*Primary Examiner*—Allen M. Ostrager
*Attorney, Agent, or Firm*—Becker & Becker

[57] ABSTRACT

A waste-heat tank which is constructed as a pressure tank, is charged with coolant, and is connected after a pressure gasification. The waste-heat tank has a cooled feed device or tubular-fin-tubular construction which includes an ash container. The waste-heat tank also has a gas/liquid heat exchanger which includes equally long tubular elements which serve as heat transfer surfaces and are integrated into tubular or planar wall units. Each element of the tubular elements is formed of a tube having an axis which is located extending generally parallel to the container axis of the waste-heat tank. Each element itself is guided in a winding manner. Each tube opens via a feed tube into the finger-like end portion of the feed device. The finger-like end portion is coated with refractory material. Each tube is arranged in an individual tubular or channel-like chamber about a polygonal, preferably hexagonal, tubular or channel-like inner space arrangement.

4 Claims, 2 Drawing Figures

WASTE-HEAT TANK

BACKGROUND OF THE INVENTION

The present invention relates to a waste-heat tank, i.e., a tank that exploits energy contained in waste gases. The waste-heat tank is constructed as a pressure tank, is charged with coolant, and is connected after a pressure gasification. The waste-heat tank is provided with a cooled feed device of tube-fin-tube construction which includes an ash container. The waste-heat tank also includes a gas/liquid heat exchanger that includes equally long tubular elements. The tubular elments serve as heat transfer surfaces and are integrated into tubular or planar wall units.

A waste-heat tank having a gas/liquid heat exchanger, yet without a cooled feed device, is known. The tubular elements serve as heat transfer surfaces of the heat exchanger. Each of the tubular elements comprises a helically wound tube. Each tubular element is disposed coaxially about a displacement body, or is uniformly disposed about a central displacement body which is coaxial with the axis of the waste-heat tank. The feed lines, that lead to these tubular elements which serve as heat transfer surfaces, open into a forged tube plate. The feed tube generally has to be cooled in the inlet region of the tube plate.

The known construction has the drawback that the use of cooled feed tubes in combination with a forged tube plate is not only expensive, but also causes problems with regard to the control of material stresses caused by temperature. Moreover, the design and arrangement of the tube bundles uneconomically increases the space and weight of the waste-heat tank.

It is therefore an object of the present invention to redesign the waste-heat tank of the aforementioned general type in such way that the previously described drawbacks are avoided while at least maintaining the efficiency of the heat exchanger; also, an economical construction results with regard to the manufacture of the waste-heat tank.

BRIEF DESCRIPTION OF THE DRAWINGS

This object, and other objects and advantages of the present invention, will appear more clearly from the following specification in connection with the accompanying drawings, in which.

SUMMARY OF THE INVENTION

Figure 1:
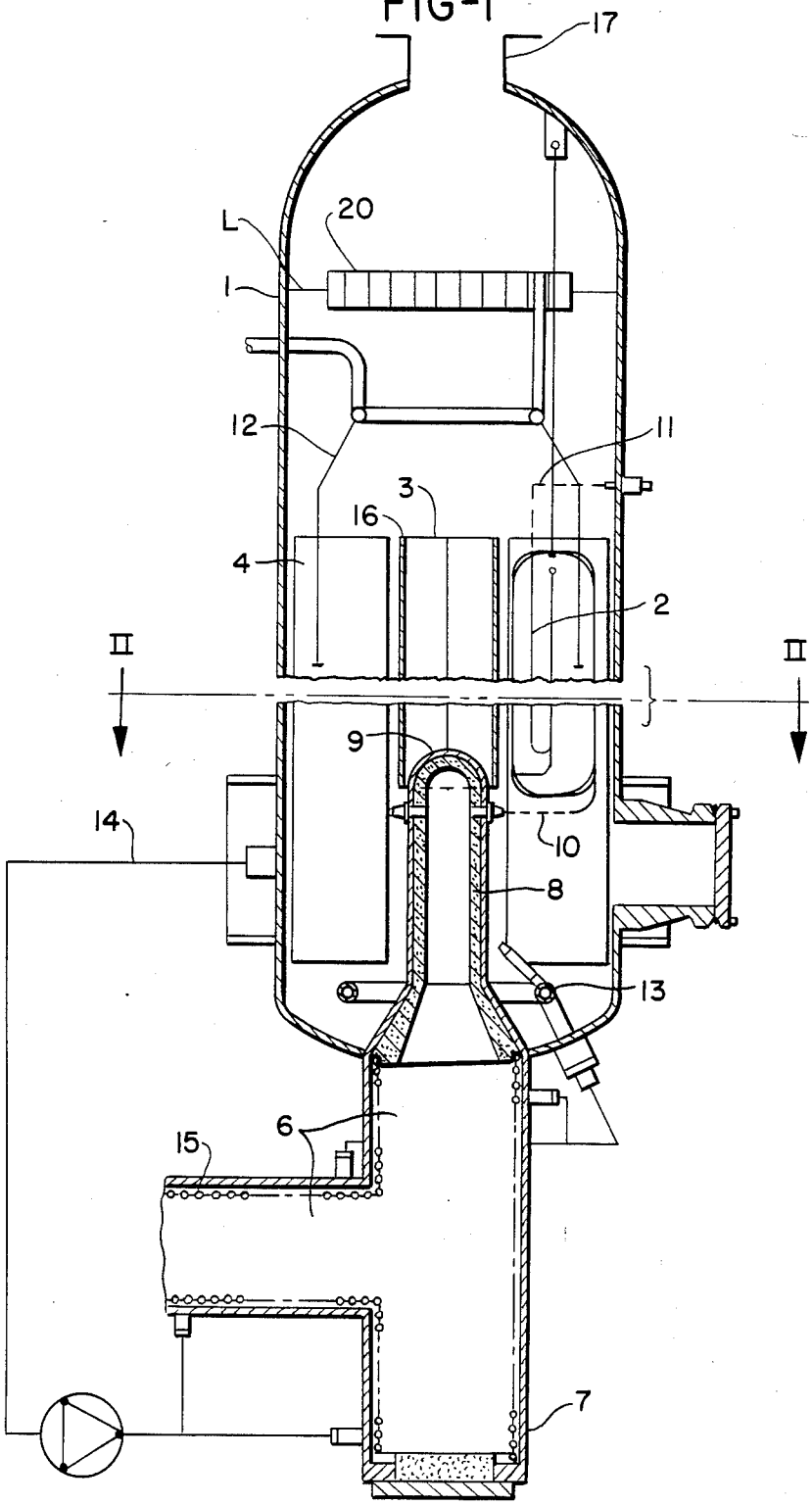
FIG. 1 is a longitudinal section of one embodiment of the inventive waste-heat tank.
Figure 2:
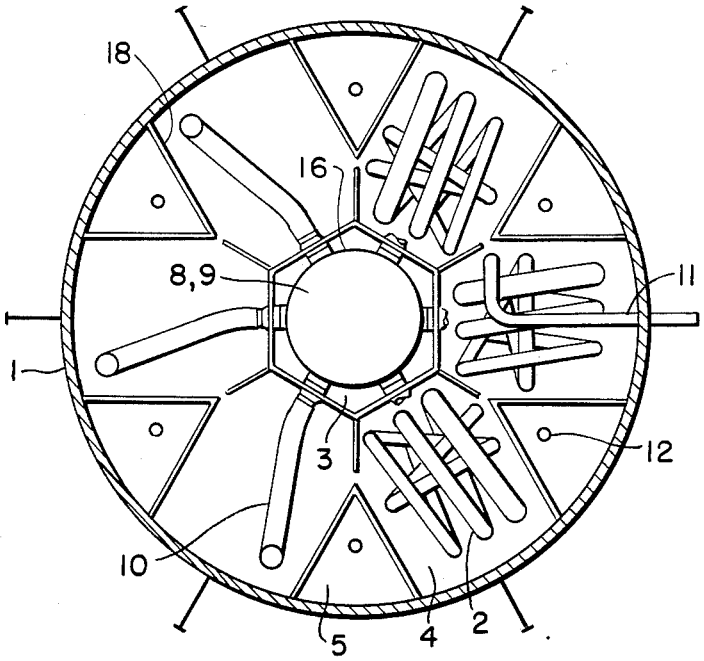
FIG. 2 is a cross section of one embodiment of the inventive waste-heat tank along line II—II in FIG. 1.

The waste-heat tank of the present invention is characterized primarily in that each element of the tubular elements of the heat exchanger is formed of a tube which is disposed parallel to the container axis of the waste-heat tank, and is guided in a winding manner. The tubular elements serve as heat transfer surfaces.

Pursuant to a further embodiment of the present invention, the feed lines of the heat-transfer-surface tubular elements of the heat exchanger open into a finger-like end portion of the feed device; this end portion is coated with refractory material. Furthermore, each tubular element is disposed in an individual tubular or channel-like chamber having open ends about a polygonal, preferably hexagonal, inner space which is provided with open ends.

Furthermore, lines of the force-cooled tubular-cross-piece-tubular wall construction of the feed device are connected with the natural circulation cooling system of the heat exchanger of the waste-heat tank.

DESCRIPTION OF A PREFERRED EMBODIMENT

Referring now to the drawings in detail, a feed device 6 is shown as a continuation of a pressure-type gasification reactor. The feed device 6 includes a wall which has a tube-fin-tube construction 15, and an ash container 7 is connected thereto. The feed device 6 is interposed between the gasification reactor and a waste-heat tank 1. The waste-heat tank is constructed as a pressure tank, and is charged with boiling water as coolant.

The feed device 6 is provided with a finger-like end portion 8 which is coated with refractory material. A feed tube 10 of the tubular elements 2 extends radially from the finger-like end portion 8 below a head 9 thereof. Each element of the tubular elements 2, is formed of a tube. The tubular elements 2 serve as heat transfer surfaces. The tube generally has an axis that is located to extend parallel to the axis of the container of the waste-heat tank 1, and the tube itself is guided in a winding manner.

The tubular elements 2 are disposed in individual tubular or channel-like chambers 4 about a polygonal, preferably hexagonal, tubular or channel-like inner space 3 formed by a polygonal insert 16. Boiling water circulates in these tubular or channel-like chambers 4 and the inner space 3, as well as in the similarly tubular or channel-like spaces 5 formed by triangular wall units or components 18 also defining the chambers 4. The boiling water circulates in the form of an upwardly and downwardly directed fluid stream due to the density variation. The natural circulation obtained in so doing can be increased by adding cold feed water over the line 12 into the downwardly directed fluid stream, or, over the line 13, by recycling the hot cooling fluid of the forced circulation cooling system of the feed device 6, 7 into the upwardly directed fluid stream. The forced circulation cooling system is connected to the natural circulation cooling system via the lines 13, 14. In this way, a high heat exchange efficiency is achieved.

An outlet tube 11 of the tubular elements 2, which serve as heat transfer surfaces, is guided below the water level L which extends in the hydro-level of a steadying grill, smoothing or calming grid or lattice 20 to the outside of the pressure tank of the waste-heat tank 1. Above the water level L and grill 20 there is a steam outlet 17 at the head of the container or tank 1.

The inventive construction has an advantage explained by the following relationships. The process gases, which result during a pressure gasification and are cooled off in the feed device, can be distributed in such a way to these tubular elements that a forged tube plate and a flanged connection between the waste-heat tank and the feed device can be eliminated. This is accomplished without cooling the feed tubes of the tubular elements 2 which serve as heat transfer surfaces in the inlet region. As a result thereof, stress and corrosion problems caused by temperature can at the same time be structurally and procedurally controlled. Due to the particular design of the heating surfaces, which are constructed as tubular elements, in connection with the cooled feed device, the length of the waste-heat tank can be reduced by one meter; its diameter can be reduced by about 5%; and its weight can be reduced by about 10%.

The present invention is, of course, in no way restricted to the specific disclosure of the specification and drawings, but also encompasses any modifications within the scope of the appended claims.

What I claim is:

1. A waste-heat tank which is constructed as a pressure tank, is charged with coolant, and is connected downstream of a pressure gasification, said waste-heat tank comprising in combination:

a cooled feed device which has a tube-fin-tube construction and includes an ash container; and a gas/liquid heat exchanger having an operative connection with said feed device, said heat exchanger including tubular elements equal in overall length which serve as heat exchange surfaces and are installed into locations defined by wall components; each tubular element being formed of a tube having an axis which is located to extend generally parallel to the container axis of said waste-heat tank, and each tube itself being guided in a winding manner; said feed device including a closed-top finger-like end portion which is coated with refractory material and which is far less thermally burdened to permit elimination of constructively costly and complex cooling thereof; said tubular elements of said heat exchanger respectively being provided with feed tubes which respectively open into said closed-top finger-like end portion to effect said operative connection of said heat exchanger with said feed device without having to cool said feed tubes of said tubular elements which serve as the heat exchange surfaces and as a result thereof stress and corrosion problems caused by temperature at the same time can be structurally and procedurally controlled, and at least one polygonal insert forming an inner space therewith as well as conduit-like chambers disposed about said space, each of said tubular elements of said heat exchanger being arranged in said conduit-like chambers provided therewith so that due to said heat exchange surfaces, which are constructed as tubular elements, in connection with said cooled feed device, length of said waste-heat tank can be reduced by one meter; diameter thereof can be reduced by about 5%; and weight thereof can be reduced by about 10%.

2. A waste-heat tank which is constructed as a pressure tank, is charged with coolant, and is connected downstream of a pressure gasification, sad waste-heat tank comprising in combination;

a cooled feed device which has a tube-fin-tube construction and includes an ash container;

a gas/liquid heat exchanger having an operative connection with said feed device, said heat exchanger including tubular elements equal in overall length which serve as heat exchange surfaces and are installed into locations defined by wall components; each tubular element being formed of a tube having an axis which is located to extend generally parallel to the container axis of said waste-heat tank, and each tube itself being guided in a winding manner; said feed device including a finger-like end portion which is coated with refractory material; said tubular elements of said heat exchanger respectively being provided with feed tubes which respectively open into said finger-like end portion to effect said operative connection of said heat exchanger with said feed device without having to cool said feed tubes of said tubular elements which serve as the heat exchange surfaces and as a result thereof stress and corrosion problems caused by temperature at the same time can be structurally and procedurally controlled; and a polygonal insert that forms a polygonal, conduit-like inner space, and conduit-like chambers disposed about said inner space; each of said tubular elements of said heat exchanger is arranged in a given one of said chambers so that due to said heat exchange surfaces, which are constructed as tubular elements, in connection with said cooled feed device, length of said waste-heat tank can be reduced by one meter; diameter thereof can be reduced by about 5%; and weight thereof can be reduced by about 10%.

3. A waste-heat tank in combination according to claim 2, in which said conduit-like inner space formed by said polygonal insert is hexagonal.

4. A waste-heat tank in combination according to claim 2, in which said heat exchanger is provided with a natural circulation cooling system wherein boiling water circulates in the form of an upwardly and downwardly directed fluid stream due to density variation, and in which said feed device is force cooled; and which includes lines interconnecting said feed device with said cooling system of said heat exchanger.

* * * * *